US010427820B2

(12) United States Patent
Guadagnini et al.

(10) Patent No.: US 10,427,820 B2
(45) Date of Patent: Oct. 1, 2019

(54) AUTOMATIC HIGH SPEED; LABELING SYSTEM HAVING AN IMPROVED LABEL STRIPPER

(71) Applicants: Kevin Guadagnini, Coarsegold, CA (US); M. Scott Howarth, Clovis, CA (US); Kris Veeck, Fresno, CA (US); Justin Graham, Clovis, CA (US); Todd Gilbert, Fresno, CA (US)

(72) Inventors: Kevin Guadagnini, Coarsegold, CA (US); M. Scott Howarth, Clovis, CA (US); Kris Veeck, Fresno, CA (US); Justin Graham, Clovis, CA (US); Todd Gilbert, Fresno, CA (US)

(73) Assignee: Sinclair Systems International LLC, Fresno, CA (US)

( * ) Notice: Subject to any disclaimer, the term of this patent is extended or adjusted under 35 U.S.C. 154(b) by 96 days.

(21) Appl. No.: 15/732,638

(22) Filed: Dec. 6, 2017

(65) Prior Publication Data

US 2018/0186490 A1 Jul. 5, 2018

Related U.S. Application Data

(60) Provisional application No. 62/498,141, filed on Dec. 14, 2016.

(51) Int. Cl.

| | |
|---|---|
| ***B65C 9/00*** | (2006.01) |
| ***B65C 9/18*** | (2006.01) |
| ***B65C 9/36*** | (2006.01) |

(52) U.S. Cl.
CPC ..... *B65C 9/0006* (2013.01); *B65C 9/1873* (2013.01); *B65C 9/1884* (2013.01); *B65C 9/36* (2013.01); *B65C 2009/0012* (2013.01)

(58) Field of Classification Search
USPC ..... 156/230, 234, 238, 249, 289, 537, 538, 156/540, 541, 542, 543
See application file for complete search history.

(56) References Cited

U.S. PATENT DOCUMENTS

| | | | | | |
|---|---|---|---|---|---|
| 3,485,414 | A * | 12/1969 | Dinter | B65C 9/1865 | 221/73 |
| 4,210,484 | A * | 7/1980 | Crankshaw | B65C 9/1884 | 156/542 |
| 4,896,793 | A * | 1/1990 | Briggs | B65C 9/1865 | 156/495 |
| 5,162,069 | A * | 11/1992 | Morris | B65C 9/1869 | 156/354 |
| 5,660,676 | A * | 8/1997 | Brooks | B65C 9/1869 | 156/361 |
| 6,230,780 | B1 * | 5/2001 | Rietheimer | B65C 11/006 | 156/541 |
| 6,896,022 | B2 * | 5/2005 | Galles | B65C 9/1869 | 156/364 |

(Continued)

*Primary Examiner* — Sing P Chan
(74) *Attorney, Agent, or Firm* — Bruce H. Johnsonbaugh

(57) ABSTRACT

An automatic high speed labeling machine with an improved label stripper is provided capable of applying 700 to 1,000 labels to individual produce items in a single lane, without tearing the label carrier strip. The improved label stripper has a contoured surface wherein only the center section contacts the label carrier strip. The edges of the carrier strip are prevented from contacting the label stripper surface.

18 Claims, 11 Drawing Sheets

(56) References Cited

U.S. PATENT DOCUMENTS 8,006,734 B2 * 8/2011 Hajny ..... B65H 37/005 156/538
8,047,250 B2 * 11/2011 Kolp ..... B65C 9/1865 156/387
8,066,044 B2 * 11/2011 Lichtenberg ..... B65C 9/26 156/351
8,167,017 B2 * 5/2012 Kolp ..... B65C 9/1865 156/387
8,524,027 B2 * 9/2013 Anwar ..... B65C 9/0006 156/247
8,714,851 B2 * 5/2014 Preliasco ..... B41J 3/36 400/611
8,882,955 B2 * 11/2014 Brandon ..... B65C 3/00 156/261
9,090,109 B1 * 7/2015 Jo ..... B41J 3/4075
9,211,966 B2 * 12/2015 Broad ..... B65C 9/1869
9,427,978 B1 * 8/2016 Hokazono ..... B65C 11/02
2002/0104623 A1 * 8/2002 Merrill ..... B65C 9/0006 156/767
2004/0089423 A1 * 5/2004 Nielsen ..... B65C 3/00 156/542
2005/0121146 A1 * 6/2005 Leonard, Jr. ..... B65C 9/0006 156/350
2006/0081333 A1 * 4/2006 Hohberger ..... B41J 3/4075 156/702
2011/0274476 A1 * 11/2011 Preliasco ..... B41J 3/36 400/578
2012/0312458 A1 * 12/2012 Auton ..... B65C 9/0006 156/212
2013/0025776 A1 * 1/2013 Anwar ..... B65C 9/0006 156/247
2013/0126100 A1 * 5/2013 Fujita ..... B65C 9/0006 156/719
2015/0203234 A1 * 7/2015 Deleu ..... B65C 9/0006 156/767
2017/0087817 A1 * 3/2017 Tomaki ..... B32B 37/0053

* cited by examiner

AUTOMATIC HIGH SPEED; LABELING SYSTEM HAVING AN IMPROVED LABEL STRIPPER

CROSS REFERENCE TO RELATED APPLICATION

This application claims the benefit of and priority from U.S. provisional application Ser. No. 62/498,141 filed Dec. 14, 2016

BACKGROUND

This invention pertains generally to the automatic labeling of individual produce items. Labeling speeds have now reached about 700 to 1,000 labels per minute for a single lane. At these high speeds, a significant problem is that label carrier strips tend to tear at their edges when the carrier strip becomes misaligned with the label stripper as the carrier strips are drawn over the label stripper. When the prior art carrier strips become misaligned, the edges of carrier strips are in greater tension than the center of the carrier strips, causing the edges to tear at the high speed noted above as the strips are drawn across the label stripper. Torn label carrier strips cause labeling down time, which in turn can cause costly downgrading of fresh produce ready to be labeled.

Another problem resulting from high labeling speeds is that polymer film labels utilizing hot melt adhesives become very flexible at elevated ambient working temperatures. The highly flexible labels tend to resist being separated from the label carrier strip, and produce items fail to be labeled. This problem becomes serious in that labeling speeds must be reduced significantly at elevated, ambient working temperatures (about 90° F. and higher) to avoid unlabeled produce. Elevated working temperatures are common in processing plants at harvest time. Reducing labeling speeds is not a satisfactory option for produce owners. A more reliable system for stripping flexible labels is needed.

BRIEF SUMMARY OF THE INVENTION

The invention provides a relatively simple, yet elegant system for minimizing the tension at the edges of the label carrier strip to reduce tearing, and simultaneously increasing the tension at the center of the carrier strip to more efficiently separate highly flexible labels from the carrier strip.

In a nutshell, the invention provides a label stripper having a novel "contoured surface" which engages only the center of the carrier strip as opposed to the typical flat edge of the prior art, which engages the entire width of the carrier strip. Whereas the prior art flat edge label stripper engages the entire width of the label carrier strip, the novel "contoured surface" includes a central "stripping segment" which is positioned in the center of the pathway of the carrier strip and engages only the central region of the carrier strip. The novel "contoured surface" also includes a pair of "separation segments" positioned laterally on opposite sides of the central stripping segment and which prevent the edges of the carrier strip from running against or engaging the surface of the label stripper. In effect, the edges of the carrier strip are separated from and do not engage the label stripper and in effect, are allowed to "float" past the label stripper.

A primary object of the invention is to reduce tearing of the label carrier strip at high labeling speeds; i.e. 700 to 1,000 labels per minute for a single lane.

Another object is to increase the speed, reliability and efficiency of stripping highly flexible labels from a label carrier strip.

A further object is to provide a high speed labeler having a label stripper with a contoured surface that tends to self-center the carrier strip Further objects and advantages will become apparent from the following disclosure and drawings wherein:

BRIEF DESCRIPTION OF THE DRAWINGS

FIG. 5C illustrates the same prior art label stripper as shown in FIG. 5A but also includes the carrier strip and a label;

FIG. 6B is an elevational view on the lie 6B-6B of FIG. 6A. FIG. 6C illustrates the novel contoured surface 240 and how it interacts with a carrier strip and label;

FIG. 7B is an elevational view on the line 7B-7B of FIG. 7A;

FIG. 8B is an elevational view on the line 8B-8B of FIG. 8A. This embodiment uses a curved plate, rather than a flat plate, for the improved label stripper.

FIG. 9B is an elevational view on the line 9B-9B of FIG. 9A. FIG. 9C is the same as FIG. 9A but also shows the carrier strip with a label moving across the label stripper.

FIG. 10B is a section on the line 10B-10B of FIG. 10A.

DETAILED DESCRIPTION OF THE DRAWINGS

FIGS. 1-9C are not to scale and are exaggerated to illustrate the problems with the prior art and to illustrate the invention.

Figure 1:
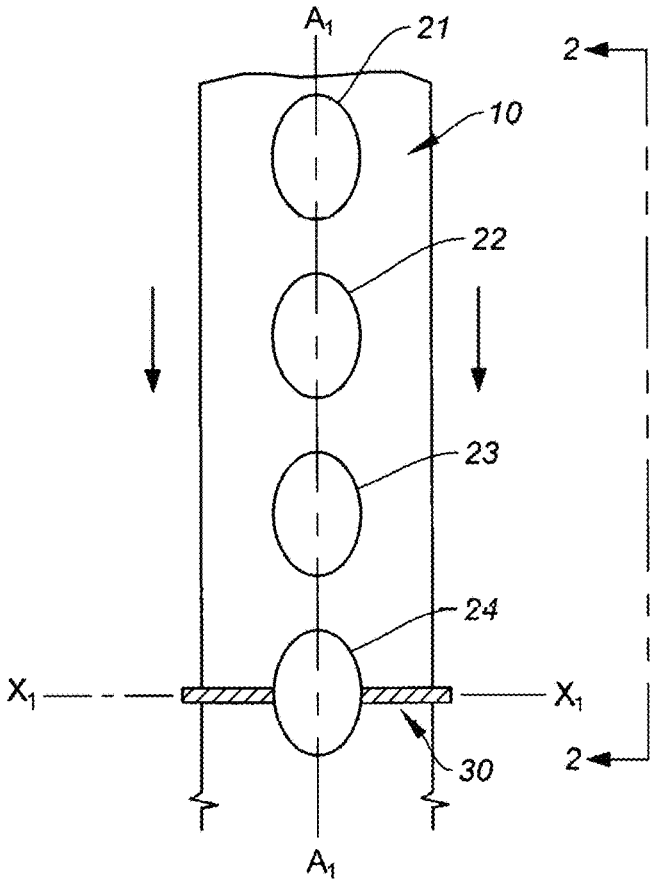
FIG. 1 (Prior Art)
FIG. 1 is a schematic representation of a prior art label stripper across which a carrier strip with labels along its center is being drawn to strip a label.
Figure 2:
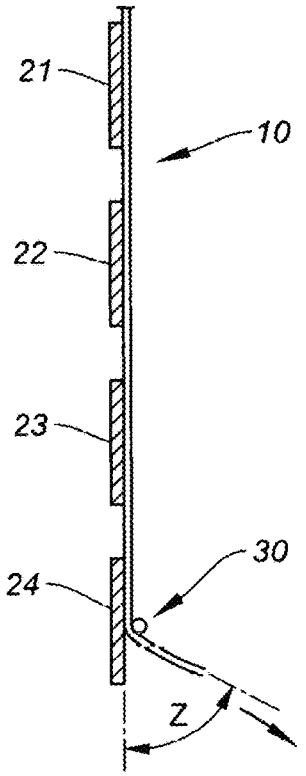
FIG. 2 (Prior Art)
FIG. 2 is a side elevational view of FIG. 1 showing a label being stripped.
Figure 3:
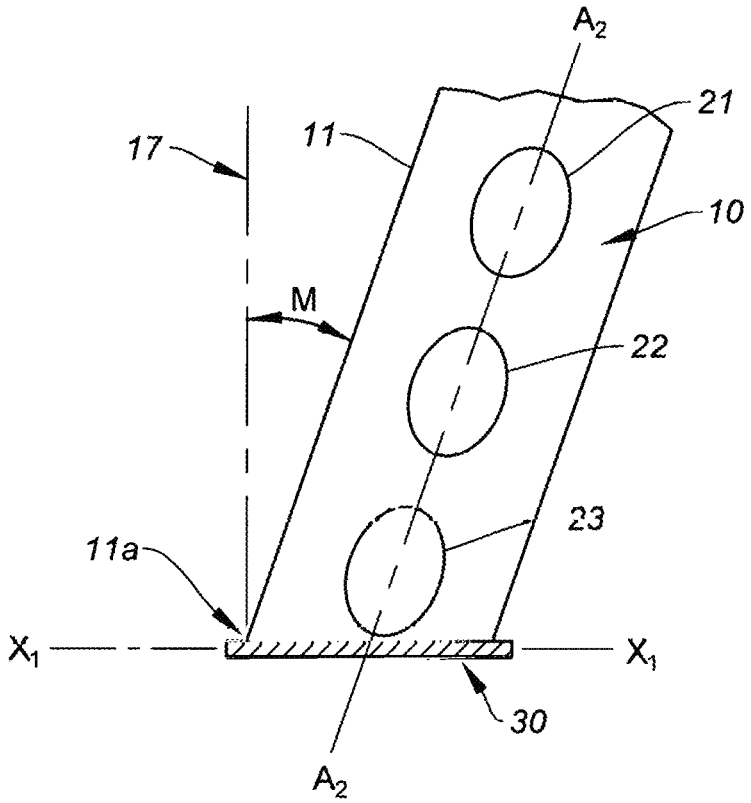
FIG. 3 (Prior Art)
FIG. 3 is a schematic illustrating the prior art problem of misalignment, wherein a carrier strip becomes misaligned, causing the carrier strip to tear.

FIGS. 1-3 illustrate how the prior art systems tend to cause the tearing problem noted above. FIG. 1 shows a label carrier strip 10 moving along a longitudinal axis $A_1$-$A_1$ toward a stationary prior art release pin (or label stripper) 30. Pin 30 is a straight pin with a cylindrical or flat cross-section, as known in the art. It is significant to note that the surface of prior art pin 30 that contacts or engages label carrier strip 10 is flat. Carrier strip 10 carries a plurality of labels 21-24 along its longitudinal center, as known in the art. FIG. 2 is a side elevational view of FIG. 1. As shown in FIGS. 1 and 2, label 24 is being successfully stripped or released from carrier strip 10 to be applied to produce or other items. Longitudinal axis $A_1$-$A_1$ of carrier strip 10 is preferably kept perpendicular to the longitudinal axis $X_1$-$X_1$ of pin 30, wherein the carrier strip is "aligned" with release pin (or label stripper) 30. It should be noted that the length of the flat pin (or stripper) 30 on the $X_1$-$X_1$ axis is greater than the width of carrier strip 10. The carrier strip 10 has its entire width drawn across the pin or label stripper 30. Also, the angle Z through which carrier strip 10 bends is between 60° and 340° as generally known in the art.

FIG. 3 illustrates label carrier strip 10 of FIG. 1 when, for various reasons, strip 10 becomes misaligned as shown by angle "M" and moves along longitudinal axis $A_2$-$A_2$ which is not perpendicular to axis $X_1$-$X_1$ of pin 30. The edge 11 of carrier strip 10 adjacent pin 30 is subjected to increased "point" tension at point 11*a* and is susceptible to tearing. The edge most susceptible to tearing is edge 11, which forms an obtuse angle with axis $X_1$-$X_1$ of pin 30. When carrier strip 10 becomes torn, labeling down time results, as noted above.

Figure 4A:
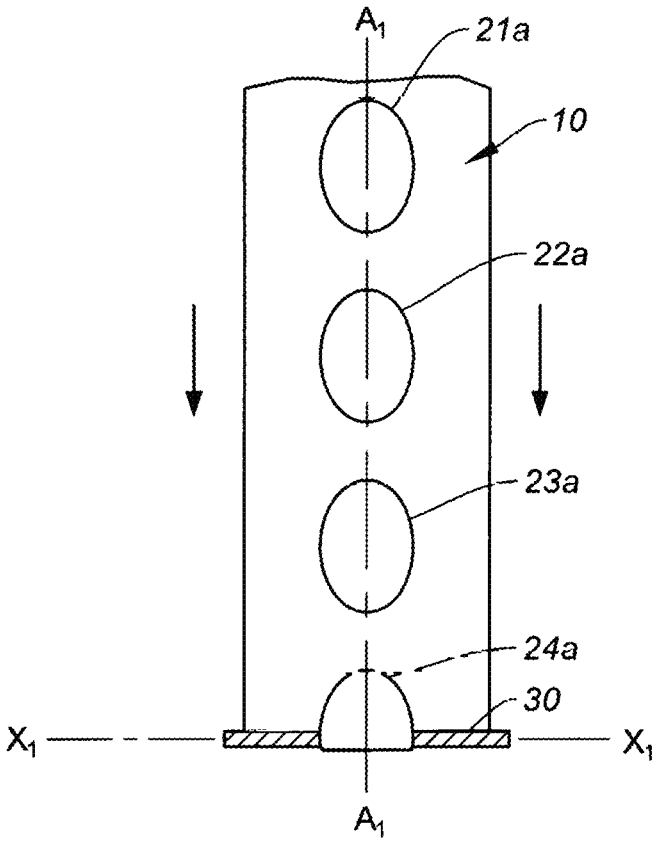
FIG. 4A (Prior Art)
FIGS. 4A-4B illustrates the prior art problem of a hot melt adhesive label adhering to the carrier strip as it is drawn past a prior art label stripper.
Figure 4B:
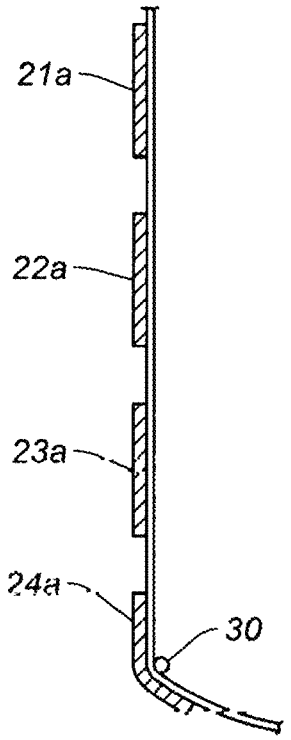
FIG. 4B (Prior Art)

FIGS. 4A and 4B illustrate the second problem noted above—that hot melt adhesive labels driven at speeds of 700 to 1,000 labels per minute across a prior art release pin 30 tend to remain adhered to carrier strip 10 when ambient working temperatures are relatively high, such as 90° F. As shown in FIG. 4B, which is a side elevation of FIG. 4A, hot melt adhesive label 24*a* simply remains attached to strip 10 as strip 10 is drawn across pin (or label stripper) 30, resulting in an unlabeled produce item.

Figure 5A:
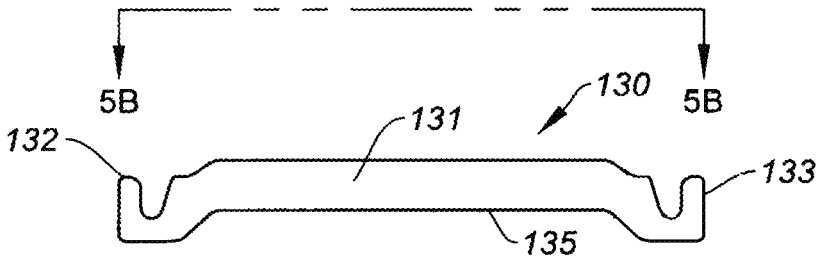
FIG. 5A (Prior Art)
FIG. 5A-5C illustrate a prior art label stripper, with FIG. 5B being an elevational view on the line 5B-5B of FIG. 5A.
Figure 5B:
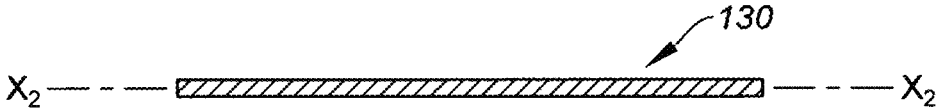
FIG. 5B (Prior Art)
Figure 5C:
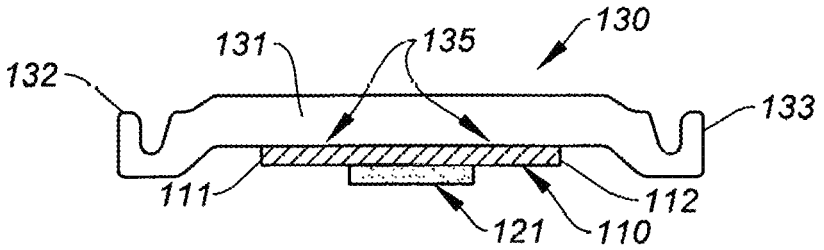
FIG. 5C (Prior Art)

FIGS. 5A-5C illustrate a prior art release (or stripper) plate 130, which is a flat or planar rectangular metal plate having a body 131 and two mounting ears 132 and 133. The label carrier strip 110 (FIG. 5C) with label 121 runs against lower edge 135, which is flat. Both problems noted above occur when using plate 130, since the edges 111 and 112 of carrier strip run against the stripping surface 135 and are subject to the "point" pressure described above. As shown in FIG. 5B, plate 130 lies in a plane.

Figure 6A:
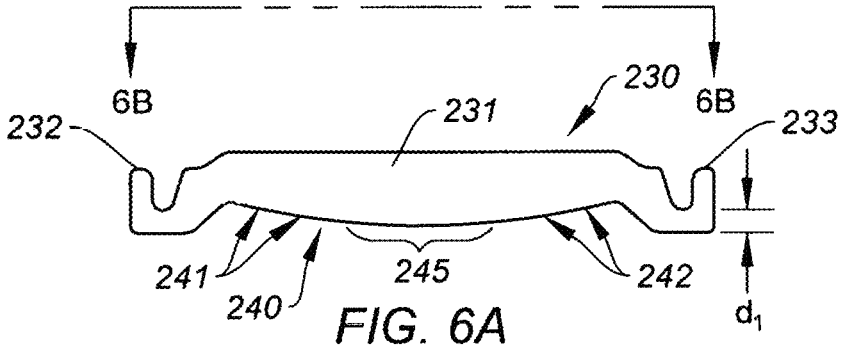
FIGS. 6A-6C illustrate a first embodiment of the present invention.
Figure 6B:
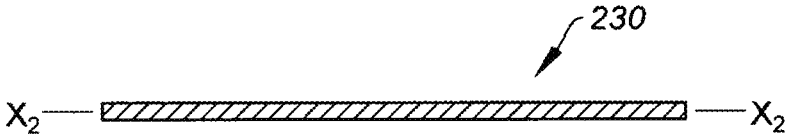
Figure 6C:
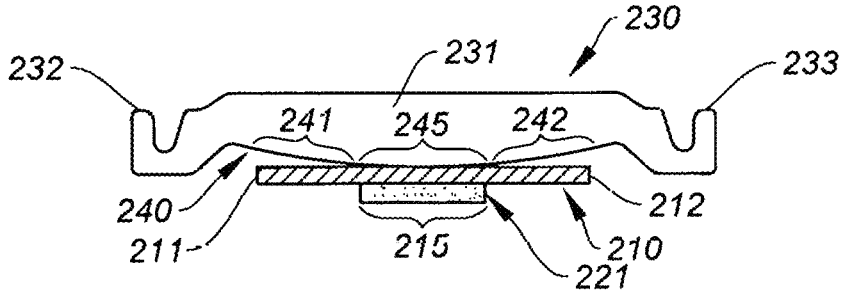

FIG. 6A-6C illustrate a first embodiment of the invention, wherein label stripper 230 comprises a generally rectangular metallic body 231, two mounting ears 232 and 233 and a contoured surface 240 which includes a central stripping segment 245 against which the center of label carrier strip 210 (FIG. 6C) runs or engages. Contoured surface 240 also includes first and second separation segments 241, 242 respectively, which are positioned laterally on opposite sides of said central stripping segment and which in the embodiment shown in FIG. 6A are curved and have surfaces inclined in a direction away from the path of the label carrier strip. The central stripping segment 245 is also curved. The contoured surface 240 in this embodiment is one continuous convex curve, extending across the entire surface 240 and having a convex shape relative to the carrier strip 210 (FIG. 6C). The contoured surface 240 has a height $d_1$ of approximately 1 mm for a width of surface 240 of 25 mm. Label stripper 230 lies in a plane as shown in FIG. 6B. As shown in FIG. 6C, the curved shape of separation segments 241 and 242 continuously separates the edges 211, 212 of the carrier strip from the contoured surface 240, and relieves the tension otherwise formed at the edges 211 and 212 of carrier strip 210, up to a designated, allowable degree of misalignment. As used herein, the term "misalignment" is the degree to which the longitudinal axis of the label carrier strip is not perpendicular to the longitudinal axis $X_2$-$X_2$ of release pin 130 (FIG. 5B) or label stripper 230 (FIG. 6B) as indicated above by angle "M" in FIG. 3 between axis $X_1$-$X_1$ and a perpendicular line 17 to axis $X_1$-$X_1$.

FIG. 6B is an elevational view on the line 6B-6B of FIG. 6A. Label stripper 230 lies in a plane and has a longitudinal axis $X_2$-$X_2$.

As shown in FIG. 6C, the smooth, curved separation segments 241 and 242 continuously separate the first and second edges 211, 212 of carrier strip 210 from the contoured label stripper surface 240, minimizing tension in those edges to reduce tearing of the carrier strip 210, and simultaneously maximizing tension along the center region 215 of carrier strip 210 (along which said labels 210 are positioned) to increase efficiency of label removal. The edges 211, 212 of carrier strip 210 move past the label stripper 230 without touching it or running against it. It is significant to note that the central stripping segment 245 of label stripper surface 240 is the only portion of contoured surface 240 against which the carrier strip 210 runs. This increased tension on the center of the carrier strip increases performance of label stripper 230 in releasing or stripping labels. This feature is most evident with polymer film labels utilizing hot melt adhesives, which tend to become more flexible at elevated temperatures. Unfortunately, this additional pressure can result in increased web breaks due to heavy die cuts created at the time of label manufacturing. We have found that the efficiency of stripping labels using hot melt adhesives is increased by at least 20% using the embodiment of FIGS. 6A-6C.

It is also significant to note that in FIG. 6C, the continuously smooth curve of surface 240 creates an inherently "self-centering" aspect to the problem of misalignment. If the edge 212 of carrier 210 starts drifting to the right in FIG. 6C, the entire carrier strip 210 will drift back to the left, because of the curvature and smoothness of surface 240.

Figure 7A:
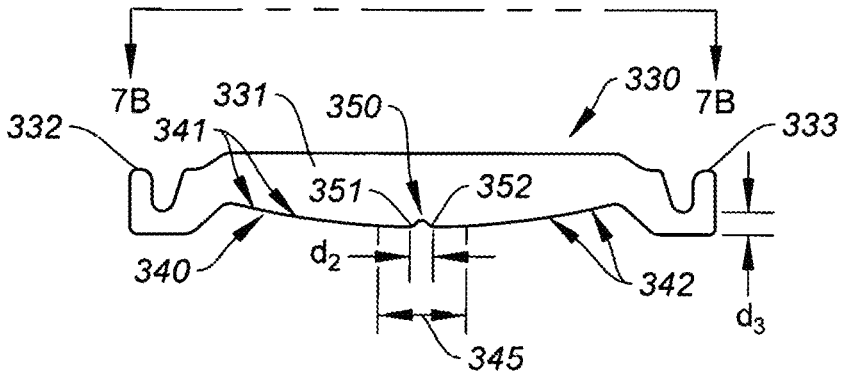
FIGS. 7A-7B illustrate a second embodiment of the present invention.
Figure 7B:
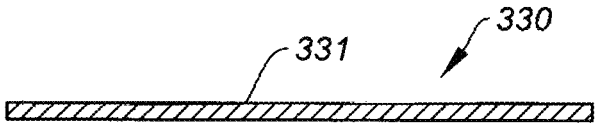

A second embodiment of the invention is shown in FIGS. 7A and 7B and differs from the embodiment shown in FIGS. 6A-6C in one respect—a center notch 350 in contoured surface 340. Label stripper 330 comprises a generally rectangular metallic body 331, two mounting ears 332 and 333, and a contoured surface 340 having a central stripping segment 345 across which the label carrier strip (not shown in FIGS. 7A and 7B) runs. The curved surface 340 has a smooth, convex shape relative to the carrier strip. Separation segments 341 and 342 on opposite sides of central stripping segment 345 form convex curves relative to the carrier strip. The curve forming surface 340 has a height $d_3$ of about 1.0 mm for a surface 340 having a length of 25 mm. The curved, separation segments 341 and 342 reduce and minimize tension in the edges of the carrier strip. The curved central portion 345 concentrates tension in the central portion of the carrier strip to increase stripping efficiency of hot melt adhesive labels. To combat the point pressure in the center of the label carrier strip, a center notch 350 is added to distribute the pressure across a designed length $d_2$. Notch 350 has two arms 351 and 352, which extend a distance $d_2$ along the length of contoured surface 340. Distance $d_2$ is preferably 2-4 mm for a contoured surface 350 having a length of 25 mm. The curve forming contoured surface 340 has a height $d_3$ of about 1 mm for a surface 340 having a length of 25 mm. The notch 350 will help relieve tearing of the carrier strip due to die cut issues, but will also reduce the label stripper performance. In a field trial, this resulted in the maximum working temperature to be reduced by 20° to maintain release of >97% of the labels, which is typical of the simple curve of edge 235 at 90° F.

Figure 8A:
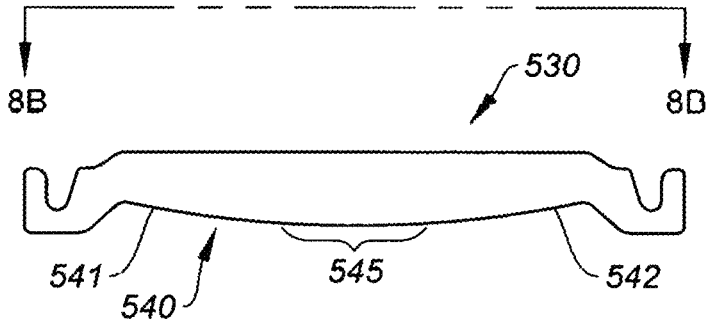
FIGS. 8A-8B illustrate a third embodiment of the invention.
Figure 8B:
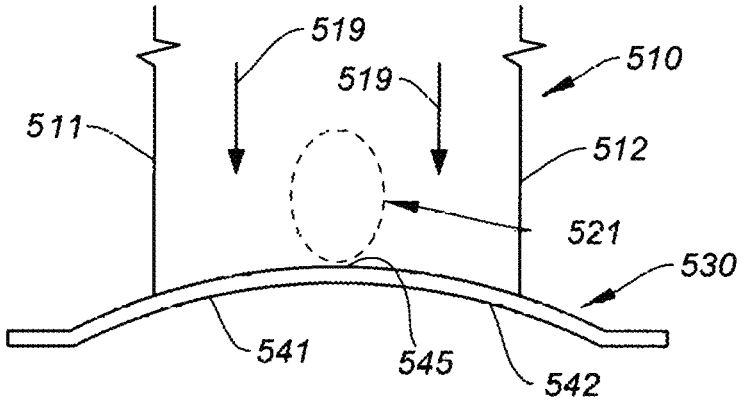

FIGS. 8A and 8B illustrate a further embodiment in which label stripper 530 is the same as label stripper 230 shown in FIGS. 6A and 6B above, except for one difference. The difference is that label stripper 230 is planar as shown in FIG. 6B, whereas label stripper 530 is a curved plate relative to the direction of travel 519 of carrier strip 510 (shown in FIG. 8B only for clarity) and forms a convex surface relative to the direction of travel 519 of carrier strip 510. Contoured surface 540 is a continuous curve, having a central stripping segment 545 and separation segments 541 and 542. FIG. 8B shows carrier strip 510 with first and second edges 511 and 512. Label 521 is on the longitudinal center of strip 510.

Figure 9A:
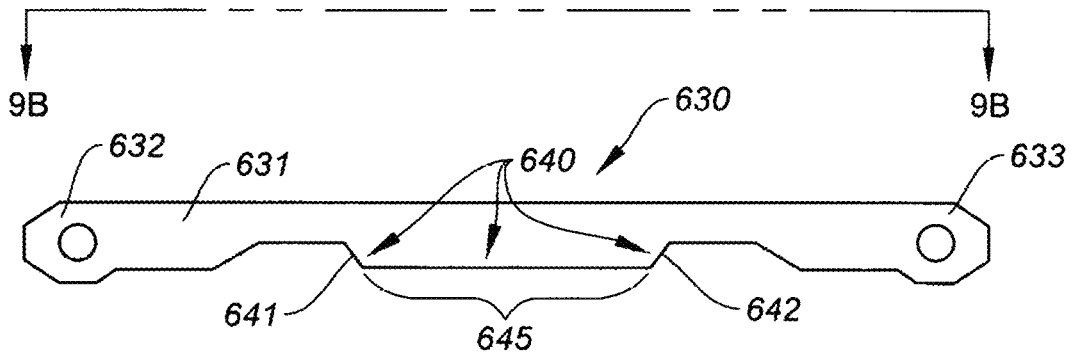
FIGS. 9A-9C illustrate a fourth embodiment of the invention.
Figure 9B:
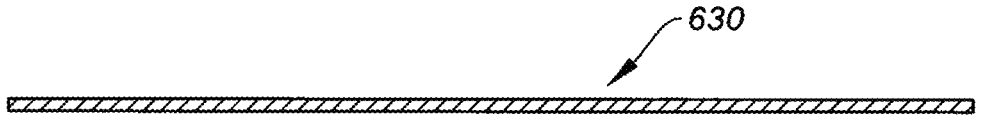
Figure 9C:
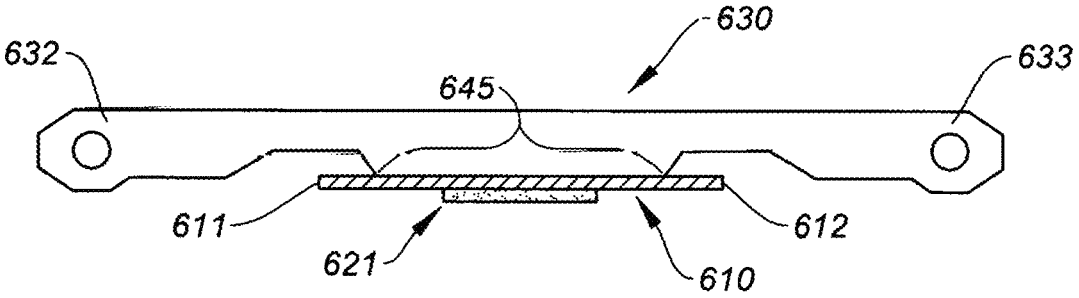

FIGS. 9A-9C illustrate another embodiment in which label stripper 630 has a relatively large central stripping segment 645 of contoured surface 640. The label stripper 630 has a body 631 and two mounting ears 632, 633. Two separation segments 641 and 642 are inclined segments with straight surfaces. The central stripping segment has a flat surface parallel to the carrier strip pathway which extends laterally more than 75% of the width of the carrier strip as shown best in FIG. 9C (FIG. 9C is the same as FIG. 9A with the carrier strip). This embodiment applies a relatively uniform tension across the central portion of the carrier strip. As shown in FIG. 9C, the edges 611 and 612 of carrier strip are continuously separated from the contoured surface 640 of the label stripper 630 and simply pass through stripper 630 without contacting any part of surface 640.

Figure 10A:
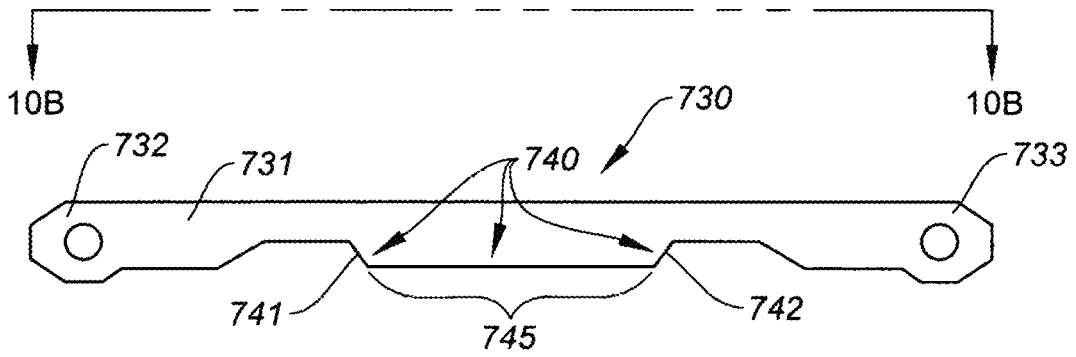
FIGS. 10A-10B illustrate a fifth embodiment of the invention.
Figure 10B:
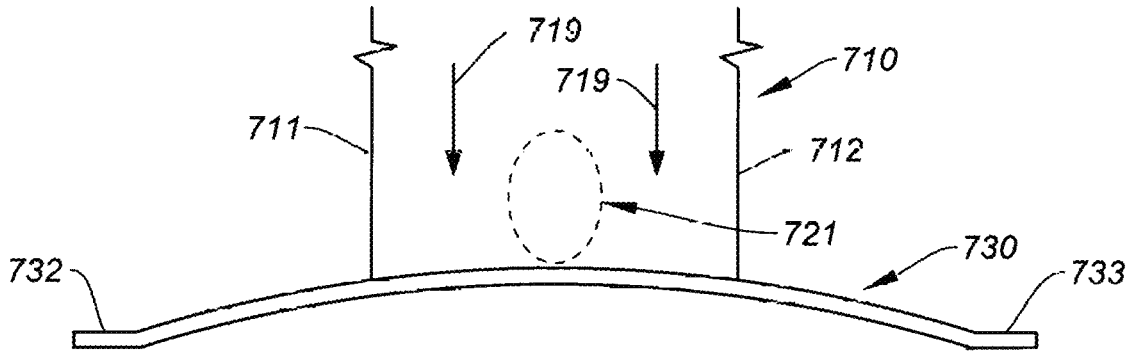

FIGS. 10A and 10B illustrate how the embodiment of FIGS. 9A-9C may be modified by using a curved plate 730 which forms a convex surface relative to the direction of travel of the carrier strip, similar to the curved plate shown in FIG. 8B. This feature assists in separating hot melt adhesive labels from the carrier strip. Label stripper 730 has a metallic body 731 and two mounting ears 732, 733. Label stripper 730 has a contoured surface 740 having a central stripping segment 745 and first and second separation segments 741, 742. FIG. 10B shows carrier strip 710 with label 721 in the center of strip 710 moving in a direction 719 across stripper 730.

Figure 11:
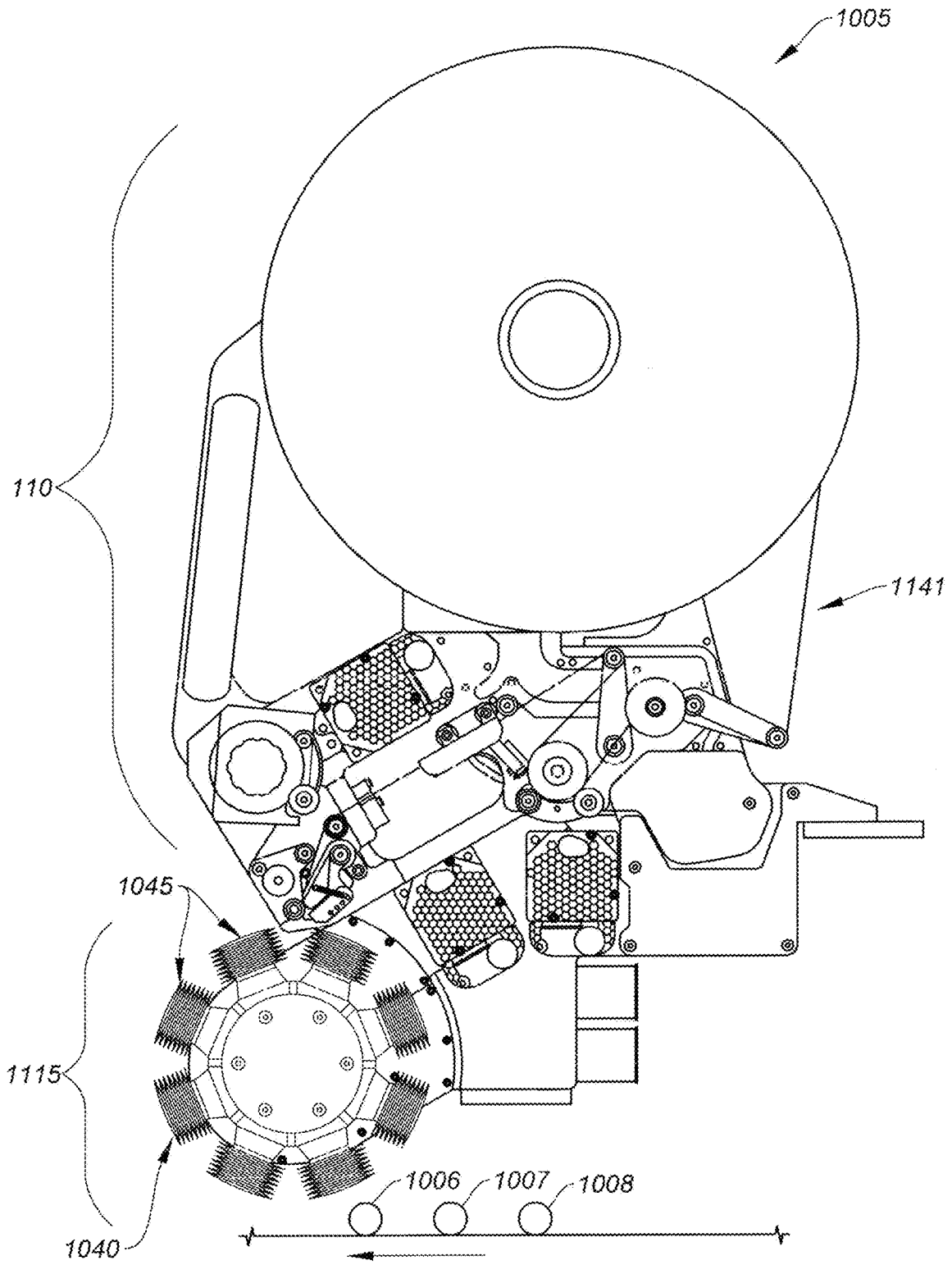
FIG. 11 (Prior Art)
FIGS. 11-12 are reproductions of two figures from prior art U.S. Pat. No. 9,457,587 to illustrate a prior art labeling machine in which the present invention operates.
Figure 12:
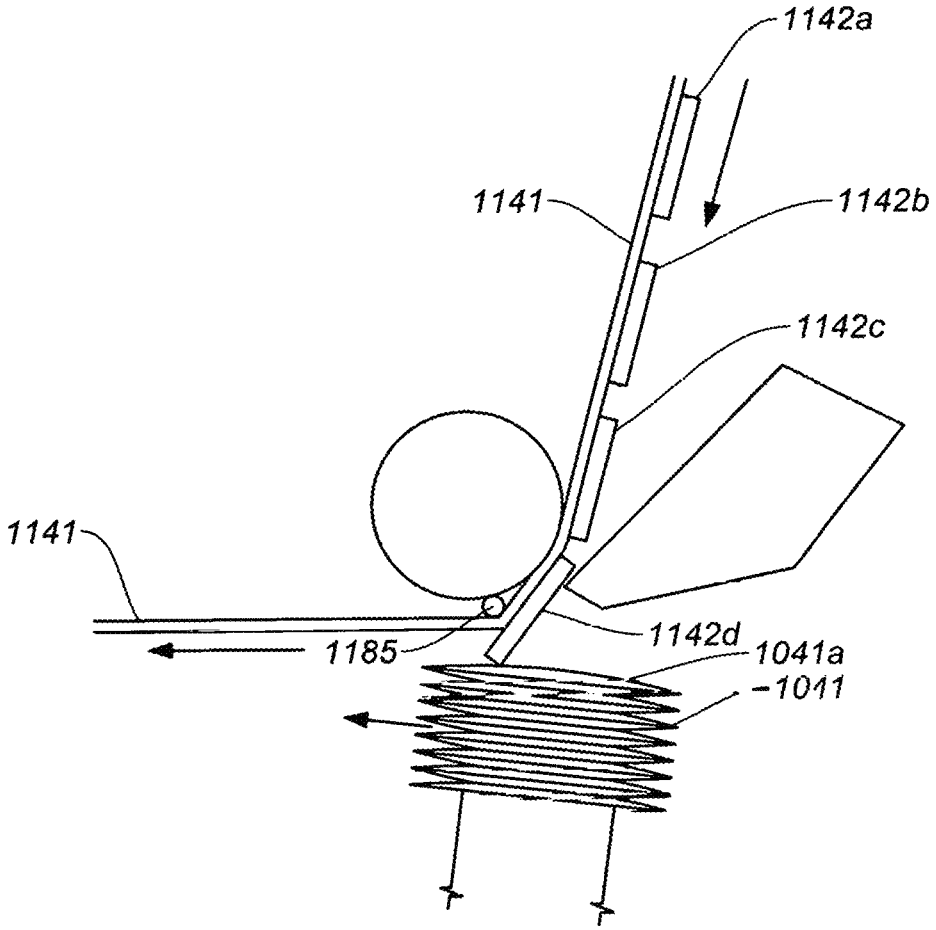
FIG. 12 (Prior Art)

FIGS. 11 and 12 illustrate one prior art labeling machine in which the present invention will operate. They are reproductions of FIGS. 2A and 3 from U.S. Pat. No. 9,457,587, with reference numbers modified. FIG. 11 shows an automatic high speed labeling machine 1,005 used to apply labels to individual items of produce 1,006-1,008. A detachable label cassette 1110 contains a large number of labels on an elongated carrier strip. A label applicator 1,115 having a plurality of bellows 1045 carried on a rotary head 1,040 includes a label stripper 1,185 (FIG. 12) to strip individual labels 1,142*a*-1,142*d* (FIG. 12) from a label carrier strip 1,141 and transfer said labels onto the tip 1,041*a* of a single bellow 1,041 and thereafter onto individual items of produce 1,006-1,008.

In accordance with the above disclosure, an improved method of high speed labeling is provided in which a contoured surface such as 240, 340, 540, 640,740 is formed having central stripping segments 245, 345, 545, 645 and 745. Each contoured surface has first and second separation segments, as described above.

Each contoured surface is positioned and shaped to cause the center 215 (FIG. 6C) of carrier strip 210 to continuously engage the central stripping segment such as 245 (FIG. 6C) to continuously strip labels. Both of the separation segments 241, 242 (FIG. 6C) are shaped and positioned to continuously separate the first and second edges 211, 212 of the carrier strip from the contoured surface 240, allow edge 211, 212 to move past the label stripper 230 without running against it or touching it. The method simultaneously maximizes tension in the center 215 of carrier strip 210 to increase efficiency of label removal, and minimizes tension in the first and second edges 211, 212 of carrier strip 210 to minimize tearing of the carrier strip. Each contoured surface remains stationary during the labeling process.

The above described method allows the labeling machine to apply between 700 and 1,000 labels per minute by a single lane, without tearing the label carrier strip. The method also increases efficiency of label removal by more than 20% for hot melt adhesive labels.

The invention disclosed herein may be used in any produce labeling machine in which release or stripping pins or plates are utilized to separate individual labels from a carrier strip. The invention is especially helpful in the labeler shown in U.S. Pat. No. 9,457,587, incorporated herein by reference as though set forth in full. The label stripper may be adjustably mounted to apply greater or less tension in the carrier strip.

The foregoing description of the invention has been presented for purposes of illustration and description and is not intended to be exhaustive or to limit the invention to the precise form disclosed. Modifications and variations are possible in light of the above teaching. The embodiments were chosen and described to best explain the principles of the invention and its practical application to thereby enable others skilled in the art to best use the invention in various embodiments suited to the particular use contemplated.

We claim:

1. An automatic, high speed produce labeling machine wherein a label applicator having a plurality of bellows carried on a rotary head includes a label stripper to strip individual labels from a label carrier strip and transfer said labels onto the tip of a single bellow, and thereafter onto individual items of produce wherein said label carrier strip has first and second edges, is drawn across said label stripper surface to separate individual labels from the center of said label carrier strip, and wherein said label carrier strip periodically becomes misaligned relative to said label stripper surface, the improved label stripper characterized by:

said label stripper having a body, two mounting ears and a contoured surface;

said contoured surface including a central stripping segment and first and second separation segments;

said central stripping segment is positioned on the center of the pathway of said carrier strip to engage and strip said labels as said carrier strip is drawn across said label stripper;

said first and second separation segments are positioned laterally on opposite sides of said central stripping segment; and both separation segments have surfaces inclined in a direction away from the path of said carrier strip, whereby as a label is stripped by said central stripping segment, said first and second edges of said carrier strip are separated from said contoured surface by said separation segments and do not contact said contoured surface of said label stripper, minimizing tension in said first and second edges of said carrier strip and maximizing tension in the center of said carrier strip.

2. The labeling machine of claim 1 wherein said label stripper is a planar metallic plate.

3. The labeling machine of claim 2 wherein said first and second end separation segments are curved.

4. The labeling machine of claim 3 wherein said inclined first and second separation segments form convex curves relative to said carrier strip.

5. The labeling machine of claim 4 wherein said contoured label stripper surface forms a continuous convex curve across said entire surface.

6. The labeling machine of claim 5 wherein said label stripper surface forms a convex surface having a notch at the center of said convex surface to relieve tension at the center of said label carrier strip.

7. The labeling machine of claim 5 wherein said continuous convex curve self centers said carrier strip.

8. The labeling machine of claim 1 wherein said inclined first and second separation segments are inclined with straight surfaces.

9. The labeling machine of claim 1 wherein said label stripper is a curved plate having a convex surface relative to the direction of travel of said label carrier strip.

10. A method for use in a high speed, automatic labeling machine used to apply labels to produce, wherein a label carrier strip having first and second edges and carrying a plurality of labels along the center of said label carrier strip is drawn across a label stripper to separate individual labels from said carrier strip, wherein said label stripper has a body, two mounting ears and a label stripping surface, wherein said label carrier strip periodically becomes misaligned relative to said label stripper, and wherein said misalignment causes tearing of said carrier strip, said method characterized by:

forming a contoured surface of said label stripper with a center stripping segment and first and second separating segments;

causing said center of said carrier strip to continuously engage said center stripping segment of said label stripper to strip labels;

simultaneously causing said separation segments of said contoured surface to continuously separate the first and second edges of said carrier strip from said contoured surface, allowing said edges to move past said label stripper without running against said label stripper;

whereby tension in the center of said carrier strip is maximized to increase efficiency of label removal, and tension in said first and second edges of said carrier strip is minimized to reduce tearing of said carrier strip; and applying said labels to said produce.

11. The method of claim 10 wherein said improved label stripper allows said machine to apply between 700 and 1,000 labels per minute by a single lane without tearing said label carrier strip.

12. The method of claim 10 wherein said increase of efficiency of label removal is at least 20% for hot melt adhesive labels.

13. The method of claim 10 wherein said inclined first and second separating segments are curved.

14. The method of claim 13 wherein said curved first and second separating segments form convex curves relative to said carrier strip.

15. The method of claim 14 wherein contoured label stripper surface forms a continuous convex curve across said entire surface.

16. The method of claim 15 wherein said label stripper surface forms a convex surface having a notch at its center to relieve tension at the center of said label carrier strip.

17. The method of claim 10 wherein said label stripper is a curved plate having a convex surface relative to the direction of travel of said label carrier strip.

18. The method of claim 10 wherein said separation segments are inclined with straight surfaces.

* * * * *